US011373579B2

(12) United States Patent
Park

(10) Patent No.: US 11,373,579 B2
(45) Date of Patent: Jun. 28, 2022

(54) DISPLAY DEVICE

(71) Applicant: LG Display Co., Ltd., Seoul (KR)

(72) Inventor: Yongjin Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/123,462

(22) Filed: Dec. 16, 2020

(65) Prior Publication Data

US 2021/0201755 A1 Jul. 1, 2021

(30) Foreign Application Priority Data

Dec. 30, 2019 (KR) ..... 10-2019-0178285

(51) Int. Cl.
*G09G 3/20* (2006.01)
*G09G 3/3225* (2016.01)
*G09G 3/3275* (2016.01)

(52) U.S. Cl.
CPC ..... *G09G 3/2092* (2013.01); *G09G 3/3225* (2013.01); *G09G 3/3275* (2013.01); *G09G 2300/0439* (2013.01); *G09G 2310/027* (2013.01); *G09G 2310/08* (2013.01); *G09G 2320/0276* (2013.01); *G09G 2320/0673* (2013.01)

(58) Field of Classification Search
CPC ..... G09G 3/2092; G09G 2310/08; G09G 2310/027; G09G 2320/0673; G09G 2300/0439; G09G 2320/0276; G09G 3/3225; G09G 3/3275; G09G 3/2007; G09G 2320/0223; G09G 2320/0233; G09G 2330/028; G09G 3/2003; G09G 3/3208; G09G 2300/0828
See application file for complete search history.

(56) References Cited

U.S. PATENT DOCUMENTS 6,107,981 A * 8/2000 Fujita ..... G09G 3/3696 345/95
6,995,758 B2 * 2/2006 Fukuda ..... G09G 3/3685 345/205
7,023,458 B2 * 4/2006 Kudo ..... G09G 3/3607 345/95
7,176,913 B2 * 2/2007 Yamada ..... G09G 3/20 345/98

(Continued)

FOREIGN PATENT DOCUMENTS

KR 10-2016-0147126 A 12/2016
KR 10-2019-0101771 A 9/2019

*Primary Examiner* — Michael J Jansen, II
(74) *Attorney, Agent, or Firm* — Fenwick & West LLP

(57) ABSTRACT

The embodiments relate to a display device including: a display panel on which multiple pixels are arranged; a first driver IC controlling driving of the pixels arranged in a first area of the display panel, and including a first gamma generator outputting multiple first gamma voltages; and a second driver IC controlling driving of the pixels arranged in a second area of the display panel, and including a second gamma generator outputting multiple second gamma voltages, wherein the first gamma generator and the second gamma generator generate the first gamma voltages and the second gamma voltages, respectively, by using multiple gamma reference voltages output from the first gamma generator.

12 Claims, 7 Drawing Sheets

(56) References Cited

U.S. PATENT DOCUMENTS 7,330,066 B2 * 2/2008 Huang ..... G09G 3/2011 327/540
7,420,529 B2 * 9/2008 Abe ..... G09G 3/3216 315/169.3
7,446,747 B2 * 11/2008 Youngblood ..... G09G 3/3688 348/674
7,486,303 B2 * 2/2009 Akai ..... G09G 3/3291 345/690
7,595,776 B2 * 9/2009 Hashimoto ..... G09G 3/3233 345/76
7,642,941 B2 * 1/2010 Tsai ..... G09G 3/3688 341/138
7,902,645 B2 * 3/2011 Nakayama ..... G09G 3/20 257/666
8,013,769 B2 * 9/2011 Kim ..... H03M 1/68 341/145
8,089,437 B2 * 1/2012 Maekawa ..... G09G 3/3655 345/212
8,525,765 B2 * 9/2013 Kim ..... G09G 3/2007 345/89
8,823,753 B2 * 9/2014 Kim ..... G09G 3/3696 345/690
8,860,767 B2 * 10/2014 Yu ..... G09G 5/10 345/690
9,082,364 B2 * 7/2015 Lin ..... G09G 3/3688
9,275,609 B2 * 3/2016 Kim ..... G09G 5/10
9,324,263 B2 * 4/2016 Sugimoto ..... G09G 3/2014
9,460,675 B2 * 10/2016 Harada ..... G09G 3/3426
9,601,043 B2 * 3/2017 Hikichi ..... G09G 3/3688
9,870,747 B2 * 1/2018 Park ..... G09G 3/3666
10,019,927 B2 7/2018 Lee et al.
10,839,768 B2 * 11/2020 Yamagishi ..... G09G 3/3696
10,878,738 B1 * 12/2020 Ju ..... G09G 3/20
11,069,278 B2 * 7/2021 Kim ..... G09G 3/20
2002/0044142 A1 * 4/2002 Fukuda ..... G09G 3/3696 345/204
2003/0132906 A1 * 7/2003 Tanaka ..... G09G 3/3688 345/89
2005/0007393 A1 * 1/2005 Akai ..... G09G 3/3291 345/690
2005/0024300 A1 * 2/2005 Abe ..... G09G 3/3225 345/76
2005/0057482 A1 * 3/2005 Youngblood ..... G09G 3/3688 345/100
2005/0168416 A1 * 8/2005 Hashimoto ..... G09G 3/3291 345/76
2005/0168429 A1 * 8/2005 Chou ..... G09G 3/3688 345/100
2005/0253831 A1 * 11/2005 Yamada ..... G09G 3/20 345/204
2006/0267672 A1 * 11/2006 Huang ..... G09G 3/2011 327/538
2007/0040855 A1 * 2/2007 Kato ..... G09G 3/3688 345/690
2008/0309681 A1 * 12/2008 Ou ..... G09G 3/3688 345/690
2009/0057808 A1 * 3/2009 Nakayama ..... H01L 23/5386 257/492
2009/0073154 A1 * 3/2009 Lee ..... G09G 3/3666 345/211
2009/0102831 A1 * 4/2009 Hashimoto ..... G09G 3/3614 345/214
2009/0207062 A1 * 8/2009 Tsai ..... G09G 3/3688 341/144
2009/0225095 A1 * 9/2009 Kojima ..... G09G 5/10 345/545
2010/0007680 A1 * 1/2010 Yu ..... G09G 5/10 345/690
2010/0225678 A1 * 9/2010 Kim ..... G09G 3/3696 345/690
2011/0032279 A1 * 2/2011 Kim ..... G09G 3/3696 345/690
2013/0057531 A1 * 3/2013 Lim ..... G09G 3/20 345/211
2013/0082998 A1 * 4/2013 Knausz ..... G09G 3/3696 345/212
2013/0093742 A1 * 4/2013 Lin ..... G09G 3/3688 345/211
2013/0300773 A1 * 11/2013 Kim ..... G09G 3/3677 345/690
2014/0160176 A1 * 6/2014 Nose ..... G09G 3/3685 345/690
2014/0292840 A1 * 10/2014 Harada ..... G09G 3/3426 345/694
2015/0002564 A1 * 1/2015 Sugimoto ..... G09G 3/3216 345/698
2015/0109348 A1 * 4/2015 Hikichi ..... G09G 3/3688 345/690
2015/0348492 A1 * 12/2015 Park ..... G09G 3/3677 345/205
2016/0365019 A1 12/2016 Lee et al.
2017/0076656 A1 * 3/2017 Bang ..... G09G 3/2092
2017/0148369 A1 * 5/2017 Park ..... G09G 3/2007
2020/0051521 A1 * 2/2020 Yamagishi ..... G09G 3/3696
2021/0193009 A1 * 6/2021 Kim ..... G09G 3/3666

* cited by examiner

FIG. 7

| LUT | Master IC | | | | | | | | | | | |
|---|---|---|---|---|---|---|---|---|---|---|---|---|
| Slave IC | 35x35 | Node0 | Node1 | Node2 | Node3 | - | - | - | - | Node32 | Node33 | Node34 |
| | Node0 | 3V | | | | | | | | | | |
| | Node1 | | 2.92V | | | | | | | | | |
| | Node2 | | | 2.84V | | | | | | | | |
| | Node3 | | | | 2.76V | | | | | | | |
| | - | | | | | | | | | | | |
| | - | | | | | | | | | | | |
| | - | | | | | | | | | | | |
| | - | | | | | | | | | | | |
| | Node32 | | | | | | | | | 0.16V | | |
| | Node33 | | | | | | | | | | 0.08V | |
| | Node34 | | | | | | | | | | | 0 |

DISPLAY DEVICE

CROSS REFERENCE TO RELATED APPLICATION

The present application claims priority to Republic of Korea Patent Application No. 10-2019-0178285, filed Dec. 30, 2019, which is incorporated by reference in its entirety.

BACKGROUND

Field of Technology

The present disclosure relates to a display device.

Description of the Related Art

As the information society has developed, various types of display devices have been developed. In recent years, various display devices, such as a liquid crystal display (LCD), a plasma display panel (PDP), and an organic light-emitting diode (OLED) display, have been used.

Among them, the organic light-emitting diode display displays an image by using an organic light-emitting device. The organic light-emitting device (hereinafter, referred to as light-emitting device) is self-luminous and does not require a separate light source, so that the thickness and the weight of the display device are reduced. In addition, the organic light-emitting diode display has high quality characteristics, such as low power consumption, high luminance, and a high response rate.

The foregoing is intended merely to aid in the understanding of the background of the present disclosure, and is not intended to mean that the present disclosure falls within the purview of the related art that is already known to those skilled in the art.

SUMMARY

The embodiments herein provide a display device having a two-chip structure, the display device including gamma generators that are provided in a respective driver integrated circuit (IC) and generate the same gamma voltage.

The embodiments herein provide a display device, wherein gamma voltages are generated by turning on a gamma reference voltage generated by a master driver IC, and the master driver IC and a slave driver IC share the generated gamma voltages.

The embodiments herein provide a display device, wherein gamma voltage values corresponding to respective grayscales are stored in a look-up table, and gamma generators provided in respective driver ICs generate the same gamma voltage.

According to an embodiment, there is provided a display device including: a display panel on which multiple pixels are arranged; a first driver IC controlling driving of the pixels arranged in a first area of the display panel, and including a first gamma generator that outputs multiple gamma voltages; and a second driver IC controlling driving of the pixels arranged in a second area of the display panel, and including a second gamma generator that outputs the multiple gamma voltages, wherein each of the first gamma generator and the second gamma generator generates the multiple gamma voltages by using multiple gamma reference voltages output from the first gamma generator.

Each of the first driver IC and the second driver IC may include a first power supply and a second power supply that generate a driving voltage.

Each of the first gamma generator and the second gamma generator may include: a reference voltage generator generating a reference voltage from the driving voltage; and a gamma voltage generator generating the multiple gamma reference voltages by dividing the reference voltage, and generating the multiple gamma voltages that correspond to multiple grayscales, respectively, by dividing the multiple gamma reference voltages.

The gamma voltage generator may include: a first circuit part generating some of the gamma reference voltages by dividing the reference voltage, and outputting the some of the gamma reference voltages through first buffers; a second circuit part generating the remaining gamma reference voltages by dividing the some of the gamma reference voltages, and outputting the remaining gamma reference voltages through second buffers; and a decoder generating the gamma voltages by dividing the multiple gamma reference voltages output from the first circuit part and the second circuit part.

An input terminal of the decoder of the second gamma generator may be connected to an output terminal of the second circuit part of the first gamma generator.

The first buffers and the second buffers of the second gamma generator may be controlled to be in an off state.

The decoder of the second gamma generator may receive the multiple gamma reference voltages output from the first circuit part and the second circuit part of the first gamma generator.

Each of the first gamma generator and the second gamma generator may include: a control interface communicating with an external host; a memory storing initially set gamma reference voltages; at least one register loading the initially set gamma reference voltages from the memory and outputting the initially set gamma reference voltages to multiple nodes, respectively; multiple digital-to-analog converters converting multiple gamma reference voltages input from the at least one register into the multiple gamma voltages and outputting the multiple gamma voltages; and multiple buffers stabilizing and outputting the multiple gamma voltages output from the multiple digital-to-analog converters.

The display device may further include a memory storing a look-up table that includes gamma reference voltages corresponding to the multiple nodes of the register.

The memory may be provided in each of the first driver IC and the second driver IC.

The multiple digital-to-analog converters of the first gamma generator and the second gamma generator may receive gamma reference voltages that are corrected by using the gamma reference voltages included in the look-up table.

Each of the first driver IC and the second driver IC may further include: a timing controller outputting image data and control signals on the basis of an image signal applied from outside; and a data driver generating data signals on the basis of the image data, the control signals, and the gamma voltages, and applying the data signals to the pixels.

Each of the first driver IC and the second driver IC may further include a synchronizer synchronizing operation timing by exchanging synchronization signals with each other.

In addition, according to an embodiment, there is provided a display device including: a first gamma voltage generator generating multiple first gamma reference voltages from first driving power, and generating multiple first gamma voltages that correspond to multiple grayscales, respectively, by dividing the multiple first gamma reference voltages; and a second gamma voltage generator generating multiple second gamma voltages by using the multiple first gamma reference voltages generated from the first gamma voltage generator.

The second gamma voltage generator may generate multiple second gamma reference voltages from second driving power that is different from the first driving power.

Each of the first gamma voltage generator and the second gamma voltage generator may include: a first circuit part generating some of the gamma reference voltages by dividing a reference voltage, and outputting the some of the gamma reference voltages through first buffers; a second circuit part generating the remaining gamma reference voltages by dividing the some of the gamma reference voltages, and outputting the remaining gamma reference voltages through second buffers; and a decoder generating the gamma voltages by dividing the multiple gamma reference voltages output from the first circuit part and the second circuit part.

An input terminal of the decoder of the second gamma voltage generator may be connected to an output terminal of the second circuit part of the first gamma voltage generator.

In the display device having the two-chip structure according to the embodiments, the difference in gamma voltage between the gamma generators provided in the respective driver ICs is eliminated.

In the display device according to the embodiments, it is possible to prevent a block dim effect from occurring on the display panel due to the difference in gamma voltage between the gamma generators provided in the respective driver ICs.

BRIEF DESCRIPTION OF THE DRAWINGS

The above and other objectives, features, and other advantages of the present disclosure will be more clearly understood from the following detailed description when taken in conjunction with the accompanying drawings, in which:

FIG. 7 is a diagram showing an example of a gamma voltage look-up table for the digital-type gamma generators according to one embodiment.

DETAILED DESCRIPTION

Hereinafter, embodiments will be described with reference to the accompanying drawings. In the specification, when an element (area, layer, part, or the like) is referred to as being "coupled to", or "combined with" another element, it may be directly coupled to/combined with the other element or an intervening element may be present therebetween. The term "and/or" includes one or more combinations that the associated elements may define.

Terms "first", "second", etc. can be used to describe various elements, but the elements are not to be construed as being limited to the terms. The terms are only used to differentiate one element from other elements. For example, the "first" element may be named the "second" element without departing from the scope of the embodiments, and the "second" element may also be similarly named the "first" element. As used herein, the singular forms "a", "an", and "the" are intended to include the plural forms as well, unless the context clearly indicates otherwise.

It is to be understood that terms such as "including", "having", etc. are intended to indicate the existence of the features, numbers, steps, actions, elements, components, or combinations thereof disclosed in the specification, and are not intended to preclude the possibility that one or more other features, numbers, steps, actions, elements, components, or combinations thereof may exist or may be added.

Figure 1:
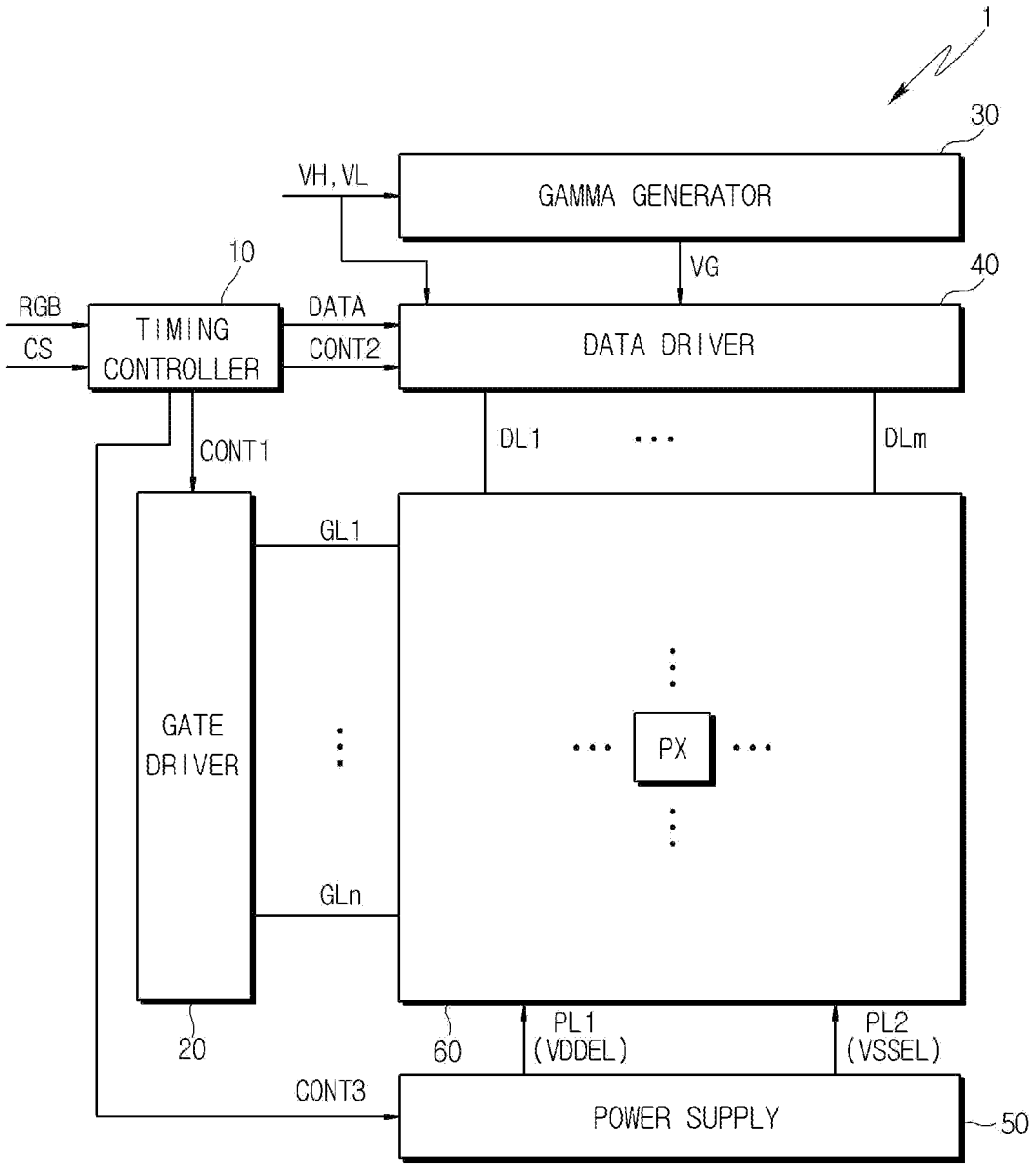
FIG. 1 is a block diagram showing a configuration of a display device according to an embodiment.

FIG. 1 is a block diagram showing a configuration of a display device according to an embodiment.

Referring to FIG. 1, a display device 1 includes a timing controller 10, a gate driver 20, a gamma generator 30, a data driver 40, a power supply 50, and a display panel 60.

The timing controller 10 may receive an image signal RGB and a control signal CS from outside. The image signal RGB may include multiple grayscale data. The control signal CS may include, for example, a horizontal synchronization signal, a vertical synchronization signal, and a main clock signal.

The timing controller 10 may process the image signal RGB and the control signal CS to make the signals appropriate for an operation condition of the display panel 60, so that the timing controller 10 may generate and output image data DATA, a gate driving control signal CONT1, a data driving control signal CONT2, and a power supply control signal CONT3.

The gate driver 20 may be connected to pixels (or subpixels) PXs of the display panel 60 through multiple gate lines GL1 to GLn. The gate driver 20 may generate gate signals on the basis of the gate driving control signal CONT1 output from the timing controller 10. The gate driver 20 may provide the generated gate signals to the pixels PXs through the multiple gate lines GL1 to GLn.

The gamma generator 30 may generate gamma voltages VGs on the basis of driving voltages VH and VL provided from the power supply 50. In an embodiment, the gamma generator 30 may generate a gamma reference voltage from the driving voltages VH and VL, and may generate gamma voltages VGs corresponding to multiple grayscales, from the gamma reference voltage.

The data driver 40 may be connected to the pixels PXs of the display panel 60 through multiple data lines DL1 to DLm. The data driver 40 may generate data signals on the basis of the image data DATA and the data driving control signal CONT2 output from the timing controller 10. The data driver 40 may receive the gamma voltages VGs generated from the gamma generator 30, may select the voltage, among the gamma voltages VGs, which corresponds to the grayscale of the image data DATA, and may generate data signals. The data driver 40 may provide the generated data signals to the pixels PXs through the multiple data lines DL1 to DLm.

The power supply 50 may be connected to the pixels PXs of the display panel 60 through multiple power lines PL1 and PL2. The power supply 50 may generate a driving voltage to be provided to the display panel 60, on the basis of the power supply control signal CONT3. The driving voltage may include, for example, a high-potential driving voltage VDDEL and a low-potential driving voltage VSSEL. The power supply 50 may provide the generated driving voltages VDDEL and VSSEL to the pixels PXs, through the corresponding power lines PL1 and PL2.

In an embodiment, the power supply 50 may further generate the driving voltages VH and VL for driving the gamma generator 30. The power supply 50 may supply the generated driving voltages VH and VL to the gamma generator 30.

In the display panel 60, the multiple pixels PXs (or referred to as subpixels) are arranged. The pixels PXs may be, for example, arranged in a matrix form on the display panel 60.

Each of the pixels PXs may be electrically connected to the corresponding gate line and the corresponding data line. Such pixels PXs may emit light with luminance corresponding to the gate signals and the data signals that are supplied through the gate lines GL1 to GLn and the data lines DL1 to DLm, respectively.

Each pixel PX may display any one among a first color to a third color. In an embodiment, each pixel PX may display any one among red, green, and blue colors. In another embodiment, each pixel PX may display any one among cyan, magenta, and yellow colors. In various embodiments, the pixels PXs may be configured to display any one among four or more colors. For example, each pixel PX may display any one among red, green, blue, and white colors.

In FIG. 1, the gate driver 20 and the data driver 40 are shown as elements separate from the display panel 60, but at least one among the gate driver 20 and the data driver 40 may be configured in an in-panel manner that is formed integrally with the display panel 60. For example, the gate driver 20 may be formed integrally with the display panel 60 according to a gate-in-panel (GIP) manner.

The timing controller 10, the gate driver 20, the data driver 40, and the power supply 50 may be configured as separate integrated circuits (ICs), or ICs in which at least some thereof are integrated. For example, the timing controller 10, the gamma generator 30, the data driver 40, and the power supply 50 may be configured as a driver IC in the form of an integrated circuit (IC). The driver IC may be implemented in the form of, for example, a flexible printed circuit board (FPCB).

Figure 2:
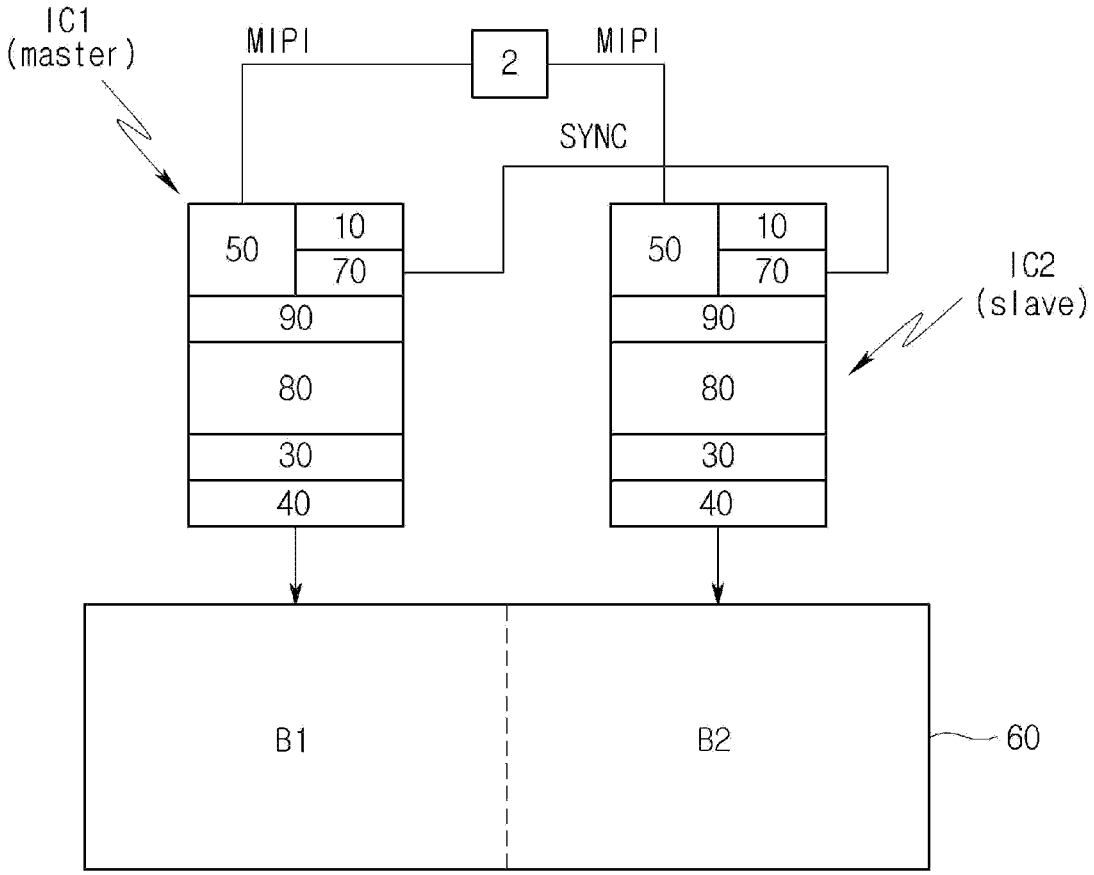
FIG. 2 is a block diagram showing a configuration of a display device composed of two driver ICs according to one embodiment.

FIG. 2 is a block diagram showing a configuration of a display device composed of two driver ICs.

As described above, in the embodiment of FIG. 1, the timing controller 10, the data driver 40, the gamma generator 30, and the power supply 50 may be configured as one driver IC. In this embodiment, the display device 1 may include two driver ICs IC1 and IC2 that drive separate areas of the display panel 60, respectively. For example, among the two driver ICs IC1 and IC2, a first driver IC IC1 may drive a first block (area) B1 of the display panel 60, and a second driver IC IC2 may drive a second block (area) B2 of the display panel 60. Herein, among the two driver ICs IC1 and IC2, the first driver IC IC1 operates as a master and the second driver IC IC2 operates as a slave.

Each of the driver ICs IC1 and IC2 communicates with a host 2 provided at outside, through Mobile Industry Processor Interface (MIPI), and may receive the image signal, the control signal, and the like, from the host 2. In addition, the driver ICs IC1 and IC2 may synchronize operation timing by exchanging synchronization signals SYNCs.

Each of the driver ICs IC1 and IC2 may include the timing controller 10, the gamma generator 30, the data driver 40, and the power supply 50. The operations of the timing controller 10, the gamma generator 30, the data driver 40, and the power supply 50 are the same as those described above with reference to FIG. 1, and thus detailed descriptions thereof will be omitted.

Each of the driver ICs IC1 and IC2 may further include a synchronizer 70 for exchanging the synchronization signals SYNCs. In addition, each of the driver ICs IC1 and IC2 may individually include a memory 80, and an algorithm executer 90 executing an algorithm required for driving the display panel 60. In an embodiment, the algorithm executer 90 may be implemented as a micro-controller unit (MCU), but it is not limited thereto.

FIG. 2 shows an example in which the display device 1 includes the two driver ICs IC1 and IC2 and two separate areas of the display panel 60 are controlled. However, the embodiment is not limited thereto. In various embodiments, the display device 1 may include a larger number of driver ICs, and the display panel 60 is divided into areas corresponding to the number of the driver ICs and the separate areas may be controlled through the respective driver ICs.

Figure 3:
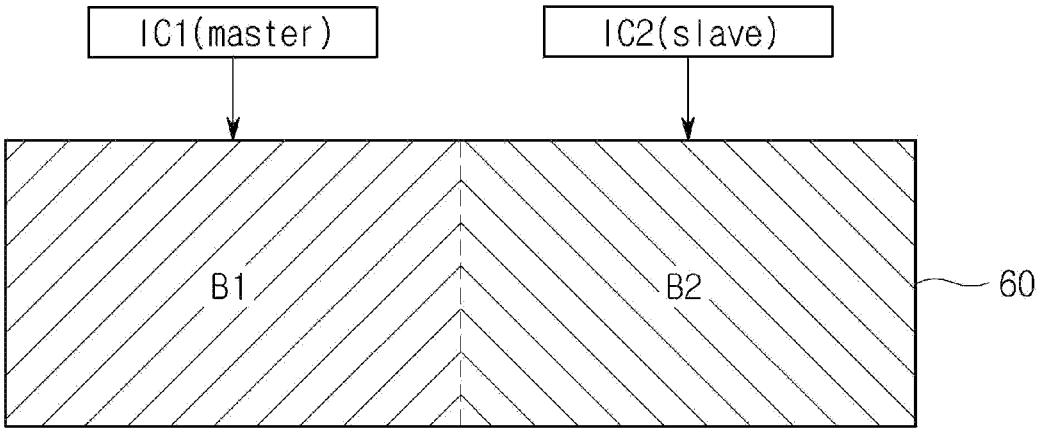
FIG. 3 is a diagram showing a block dim effect that occurs in the display device shown in FIG. 2 according to one embodiment.

FIG. 3 is a diagram showing a block dim effect that occurs in the display device shown in FIG. 2.

In the display device 1 shown in FIG. 2, power supplies 50 are provided inside the driver ICs IC1 and IC2, respectively. Herein, even though the driver ICs IC1 and IC2 are manufactured by the same process and design method, variations in chip characteristic may occur. As a result of this, the power values generated by the power supplies 50 of the respective driver ICs IC1 and IC2 may differ.

The gamma generator 30 generates the gamma voltages VGs on the basis of the driving voltages VH and VL applied from the power supply 50, and the like. The data driver 40 generates the data signal on the basis of the gamma voltage VG generated by the gamma generator 30. Herein, when the values of the driving voltages VH and VL generated by the driver IC IC1 are different from those of the driving voltages VH and VL generated by the driver IC IC2, different data voltage values generated by the respective driver ICs IC1 and IC2 are set for the same grayscale. Accordingly, a block dim effect may occur due to the grayscale variation between the first block B1 and the second block B2 on the display panel 60 which are driven by the respective driver ICs IC1 and IC2.

In the following embodiments, in order to reduce such a block dim effect, there is provided a method of generating the same gamma voltages by the gamma generators 30 in the respective driver ICs IC1 and IC2.

Figure 4:
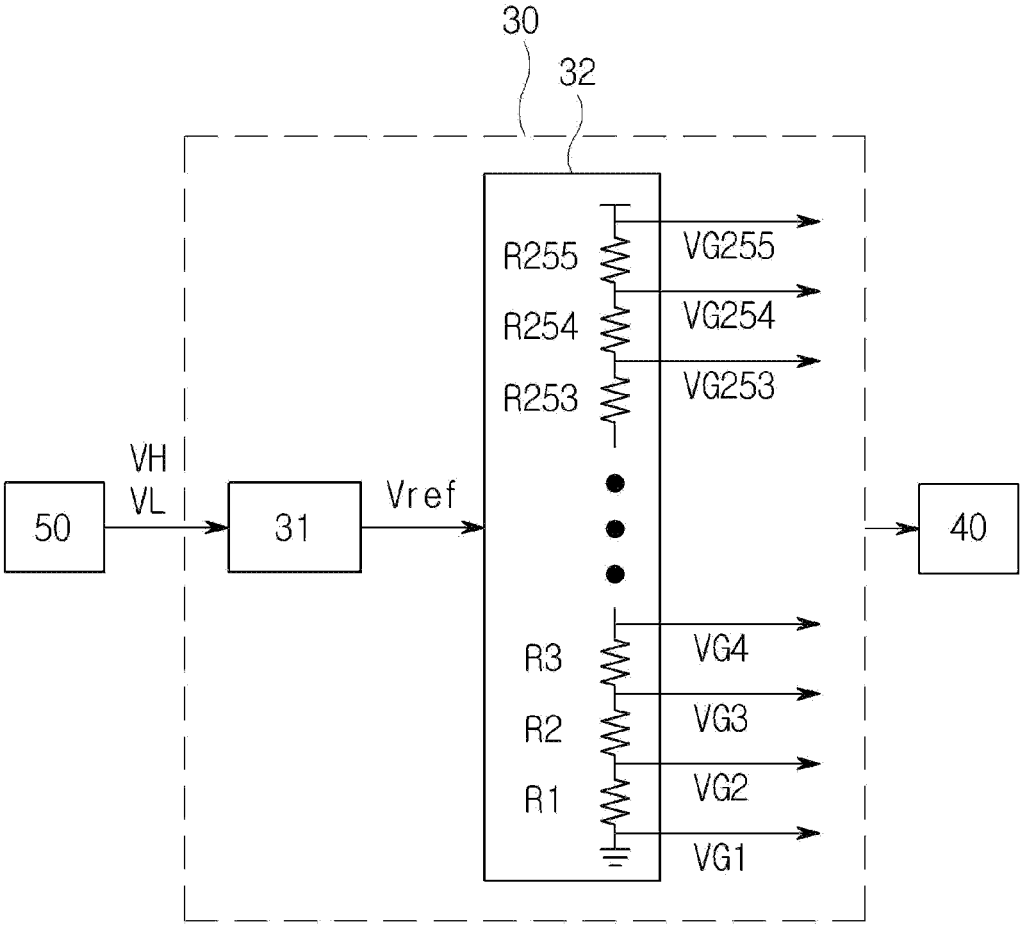
FIG. 4 is a diagram showing an example of an analog-type gamma generator according to one embodiment.
Figure 5:
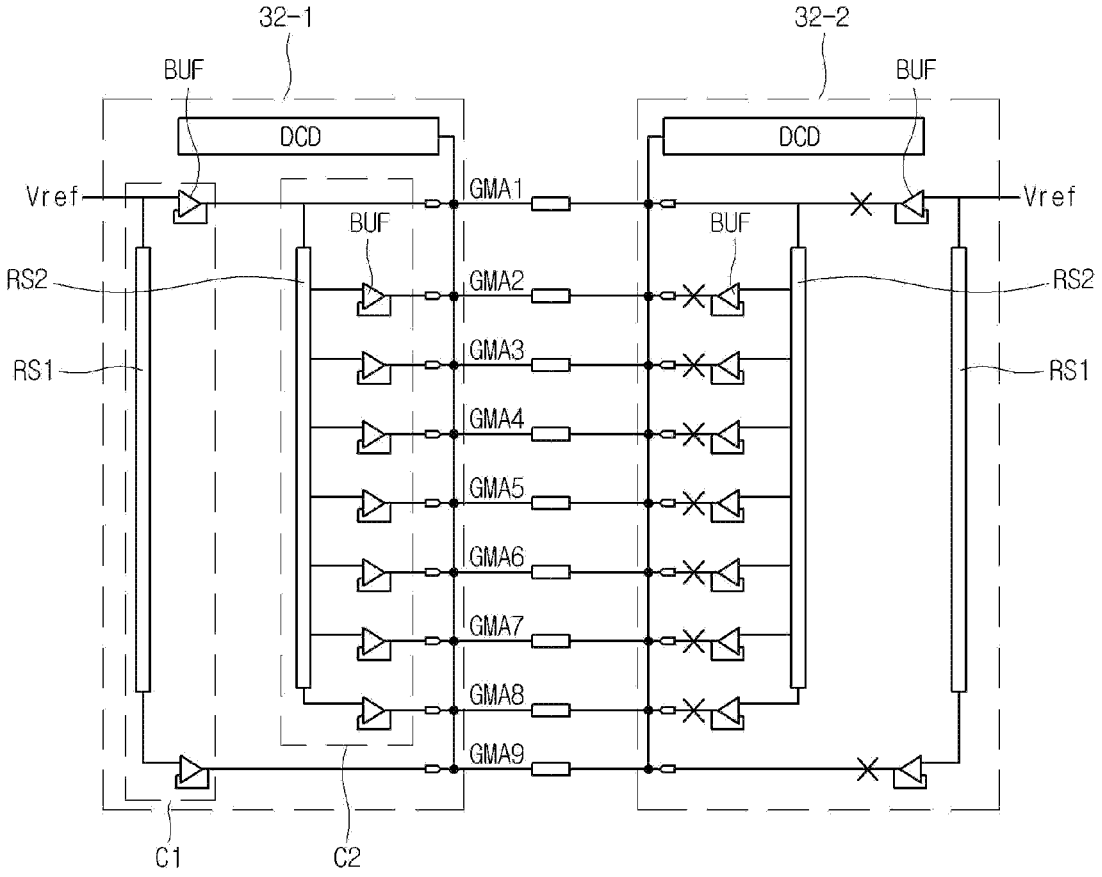
FIG. 5 is a diagram showing a connection relationship between analog-type gamma generators provided in multiple driver ICs according to one embodiment.

FIG. 4 is a diagram showing an example of an analog-type gamma generator. FIG. 5 is a diagram showing a connection relationship between analog-type gamma generators provided in multiple driver ICs.

In an embodiment, the gamma generator 30 may be designed in an analog type as shown in FIG. 4. In this embodiment, the gamma generator 30 may include a reference voltage generator 31, and a gamma voltage generator 32.

The reference voltage generator 31 may generate a reference voltage Vref by using the driving voltages VH and VL supplied from the power supply 50. In an embodiment, the reference voltage Vref may have a level lower than the high-potential driving voltage VH, but it is not limited thereto.

The gamma voltage generator 32 may generate a gamma voltage VG from the reference voltage Vref that is supplied from the reference voltage generator 31. For example, the gamma voltage generator 32 may generate multiple voltages by dividing the reference voltage Vref supplied from the reference voltage generator 31, and may select, among the generated voltages, the voltage indicated by a register setting value and may thus generate gamma voltages VG1 to VG1024 corresponding to all the grayscales, respectively.

In an embodiment, the gamma voltage generator 32 may be composed of a string of registers R1 to R255 connected in series as shown in FIG. 4. The gamma voltage generator 32 may divide the reference voltage Vref through the string of registers R1 to R255, and may thus generate the multiple gamma voltages VG1 to VG255.

The number of the gamma voltages VG1 to VG255 may correspond to the number of the grayscales to be displayed on the display device 1. For example, when 255 grayscales are desired to be displayed on the display device 1, 255 gamma voltages VG1 to VG255 may be formed.

Corresponding to the number of the gamma voltages VG1 to VG255 to be generated, the number of registers arranged in the string of the registers R1 to R255 may be determined. The embodiment shows an example in which 255 gamma voltages VG1 to VG255 are generated, but the embodiment is not limited thereto, and a smaller or larger number of gamma voltages VG1 to VG255 may be generated.

The gamma generator 30 as described above generates the reference voltage Vref from the driving voltages VH and VL applied from the power supply 50, divides the reference voltage Vref, and thus generates the gamma voltages VG1 to VG255. Therefore, when driving voltages VH and VL generated by the power supply 50 of the driver IC IC1 are different from those generated by the power supply 50 of the driver IC IC2 shown in FIG. 2, the gamma generators 30 provided in the two respective driver ICs IC1 and IC2 generate a reference voltage Vref of different voltage values, resulting in generation of different gamma voltages VG1 to VG255. This may result the block dim effect on the display panel 60.

To prevent this, the embodiment provides a structure that enables the driver ICs IC1 and IC2 to output the same gamma voltages VGs.

Specifically, referring to FIG. 5, the first driver IC IC1 includes a first gamma voltage generator 32-1, and the second driver IC IC2 includes a second gamma voltage generator 32-2. Each of the gamma voltage generators 32-1 and 32-2 may include a first circuit part C1, a second circuit part C2, and a decoder DCD.

The first circuit part C1 divides the reference voltage Vref input from the reference voltage generator 31, through a first string RS1 of registers and generates gamma reference voltages GMA1 and GMA9. The gamma reference voltages GMA1 and GMA9 selected by the first circuit part C1 may be output through buffers BUFs.

The second circuit part C2 divides the gamma reference voltages GMA1 and GMA9 output from the first circuit part C1, through a string of registers. The second circuit part C2 may select the remaining gamma reference voltages GMA2 to GMA8 from the divided voltages, and may output the resulting voltages through buffers BUFs.

The decoder DCD may divide the gamma reference voltages GMA1 to GMA9 output from the first and the second circuit part C1 and C2, and may thus output the gamma voltages VG1 to VG255. For example, the decoder DCD may divide the gamma reference voltages GMA1 to GMA9 through the string of registers R1 to R255 as shown in FIG. 4, and may thus generate the multiple gamma voltages VG1 to VG255.

In this embodiment, the first gamma voltage generator 32-1 and the second gamma voltage generator 32-2 are designed to share the same gamma reference voltage. To this end, the gamma reference voltages of any one among the first driver IC IC1 and the second driver IC IC2, for example, the second driver IC IC2 that operates as a slave, are controlled to be off.

For example, the buffers BUFs provided in the first circuit part C1 and the second circuit part C2 of the second gamma voltage generator 32-2 may be controlled to be in an off state. When the buffers BUFs of the first circuit part C1 are controlled to be in an off state, the some gamma reference voltages GMA1 and GMA9 generated by the first circuit part C1 of the second gamma voltage generator 32-2 are not provided to the second circuit part C2, so that the second circuit part C2 is unable to generate the remaining gamma reference voltages GMA2 to GMA8. Even though a batch of the gamma reference voltages GMA2 to GMA8 is generated by the second circuit part C2, when the buffers BUFs of the second circuit part C2 are controlled to be in an off state, the gamma reference voltages GMA2 to GMA8 generated by the second circuit part C2 are not applied to the decoder DCD.

Instead, the gamma reference voltages GMA1 to GMA9 generated by the first gamma voltage generator 32-1 are input to the decoder DCD of the second gamma voltage generator 32-2. That is, an input terminal of the decoder DCD of the second gamma voltage generator 32-2 is connected to an output terminal of the second circuit part C2 of the first gamma voltage generator 32-1. Accordingly, the decoder DCD of the second gamma voltage generator 32-2 receives the gamma reference voltages GMA1 to GMA9 output from the first circuit part C1 and the second circuit part C2 of the first gamma voltage generator 32-1. The decoder DCD of the second gamma voltage generator 32-2 may divide the gamma reference voltages GMA1 to GMA9 output from the first circuit part C1 and the second circuit part C2 of the first gamma voltage generator 32-1, and may thus output the gamma voltages VG1 to VG255.

In various embodiments, between the input terminal of the decoder DCD of the second gamma voltage generator 32-2 and the output terminal of the second circuit part C2 of the first gamma voltage generator 32-1, registers Rs for resistance matching may be further provided.

As described above, the first gamma voltage generator 32-1 and the second gamma voltage generator 32-2 share the gamma reference voltages GMA1 to GMA9 generated by the first gamma voltage generator 32-1, so that the same gamma voltages VG1*s* to VG1024*s* may be generated. Since the gamma voltages VG1 to VG255 generated by the first gamma voltage generator 32-1 are the same as the gamma voltages VG1 to VG255 generated by the second gamma voltage generator 32-2, respectively, grayscale variation between the first block B1 and the second block B2 that are controlled by the first driver IC IC1 and the second driver IC IC2, respectively, may be eliminated Consequently, the block dim effect may be prevented.

Figure 6:
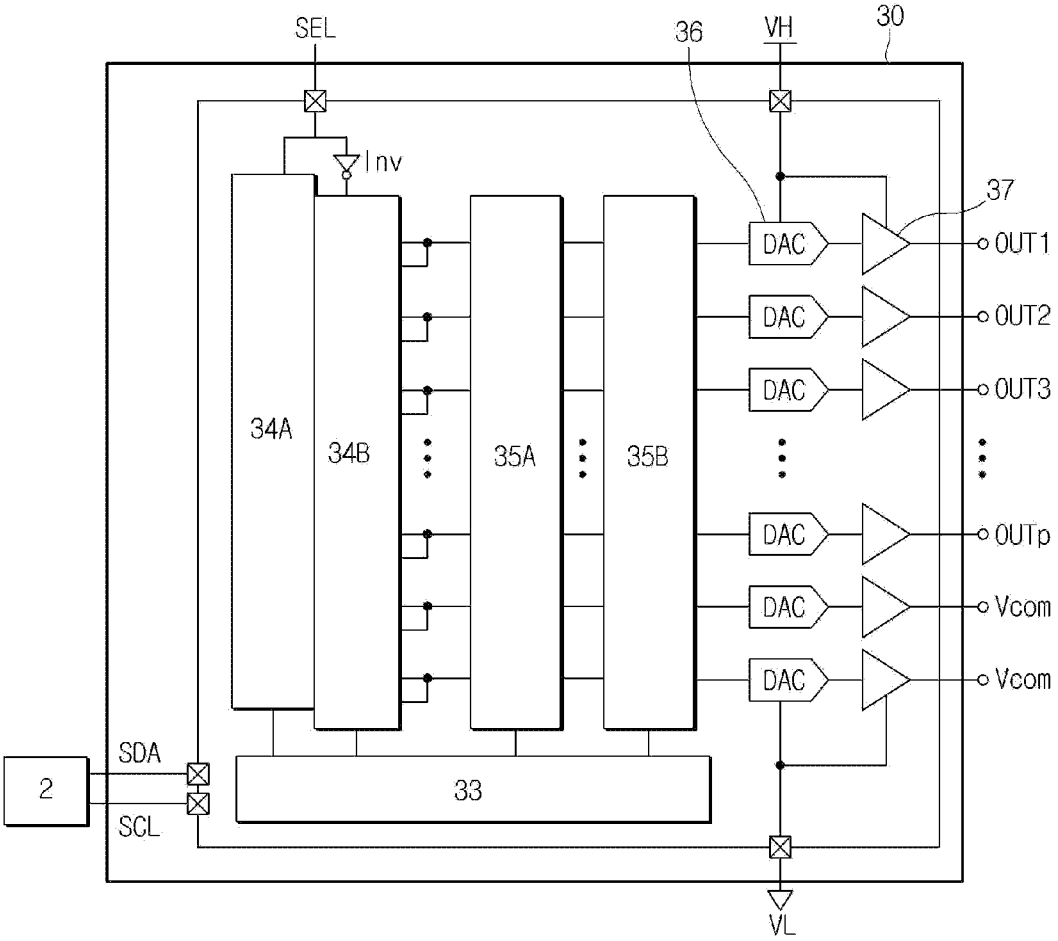
FIG. 6 is a diagram showing an example of a digital-type gamma generator according to one embodiment.

FIG. 6 is a diagram showing an example of a digital-type gamma generator. FIG. 7 is a diagram showing an example of a gamma voltage look-up table for the digital-type gamma generators.

In an embodiment, the gamma generator 30 may be designed in a digital type as shown in FIG. 6. In this embodiment, the gamma generator 30 may be configured as a programmable gamma IC.

Referring to FIG. 6, the gamma generator 30 may include a control interface 33, a first and a second memory 34A and 34B, registers 35A and 35B, digital-to-analog converters (hereinafter, referred to as "DACs") 36, and buffers 37.

A serial clock SCL and serial data SDA synchronized with the serial clock SCL, which are output from the host 2, are input to the gamma generator 30. The high-potential driving voltage VH and the low-potential driving voltage VL are supplied to the gamma generator 30. The low-potential driving voltage VL may be a base voltage GND 0V.

The control interface 33 supplies control data that is input as the serial data SDA, to the registers 35A and 35B. The control interface 33 writes the control data on the registers 35A and 35B. When the control data is supplied from the host 2 through the control interface 33, the gamma generator 30 outputs an internally set gamma reference voltage, under control by the host 2.

The set internally gamma reference voltages may be stored in the first and the second memory 34A and 34B. For example, a positive gamma reference voltage may be stoned in the first memory 34A, and a negative gamma reference voltage may be stored in the second memory 34B. The first and the second memory 34A and 34B may be implemented as a non-volatile type.

A selection signal SEL output from the host 2, or the like is input to the first and the second memory 34A and 34B. Herein, the selection signal SEL inverted by an inverter Inv is input to the second memory 34B. According to the selection signal SEL, a gamma reference voltage stored in any one among the first and the second memory 34A and 34B is output to the registers 35A and 35B. For example, when the selection signal SEL at a high logic level is input, a gamma reference voltage stored in the first memory 34A is output to the first register 35A. When the selection signal SEL at a low logic level is input, a gamma reference voltage stored in the second memory 34B is output to the second register 35B.

In an embodiment, output from the first memory 34A and the second memory 34B may be alternated at intervals of one frame. Herein, the control interface 33 generates a memory read/write clock for supplying the gamma reference voltages stored in the first and the second memory 34A and 34B to the registers 35A and 35B, and inputs the memory read/write clock to the first and the second memory 34A and 34B and the registers 35A and 35B.

The registers 35A and 35B are implemented as a rewritable memory. The registers 35A and 35B temporarily store the gamma reference voltages under control by the control interface 33, and then supply the gamma reference voltages to the DACs 36.

In various embodiments, the registers 35A and 35B may include a first register 35A and a second register 35B. The first register 35A may output the positive gamma reference voltage, and the second register 35B may output the negative gamma reference voltage. The first register 35A and the second register 35B may have the same configuration except that the gamma reference voltage is output in an inverted form.

The gamma reference voltage is independently applied to each of the DACs 36. In addition, the DACs 36 access respective output channel pins OUT1 to OUTp (herein, p is a natural number of 2 or more) in a 1:1 manner. One or some of the DACs 36 may be designed to access a common voltage output pin Vcom and output a common voltage.

Each of the DACs 36 divides a gamma reference voltage in the form of a digital voltage output from the registers 35A and 35B, and converts the resulting voltages into gamma voltages in the form of an analog voltage for output. Each of the DACs 36 may output the gamma voltages, corresponding to the gamma reference voltage value.

The buffers 37 are connected between output terminals of the DACs 36 and the output channel pins OUT1 to OUTp. Considering fluctuation in the load of the gamma generator 30, the buffers 37 stabilize the gamma voltages output through the output channel pins OUT1 to OUTp.

In the case where such a digital-type gamma generator 30 is provided in each of the two driver ICs IC1 and IC2 shown in FIG. 3, due to the difference in characteristic between the programmable gamma ICs, the gamma reference voltages output from the registers 35A and 35B of the driver IC IC1 are different from those output from the registers 35A and 35B of the driver IC IC2. Then, the gamma voltages VG1 to VG255 generated by the DACs 36 and the buffers 37 of the driver IC IC1 are different from those generated by the DACs 36 and the buffers 37 of the driver IC IC2, which may cause the block dim effect on the display panel 60.

To prevent this, the embodiment provides a structure that enables the driver ICs IC1 and IC2 to output the same gamma voltages VGs.

Specifically, referring to FIG. 7, gamma reference voltages required for the gamma generators 30 of the first driver IC IC1 and the second driver IC IC2 may be stored in a look-up table form. The number of the gamma reference voltages stored in the look-up table may correspond to the number of nodes to which the gamma reference voltages are output from the registers 35A and 35B. FIG. 7 shows the case, as an example, where the number of the nodes to which the gamma reference voltages are output from the registers 35A and 35B is 35, but the embodiment is not limited thereto.

This look-up table may be stored, for example, in a memory provided in the host 2, or the like, and/or in the memories 80 provided in the respective driver ICs IC1 and IC2. The required gamma reference voltages in the look-up table may be applied directly to the registers 35A and 35B of the gamma generator 30. The registers 35A and 35B may compare the gamma reference voltages output from the first and the second memory 34A and 34B with the required gamma reference voltages applied from the look-up table, may correct the gamma reference voltages according to a result of comparison, and may output the corrected gamma reference voltages.

Alternatively, the gamma reference voltages stored in the look-up table may be applied to the input terminals of the DACs 36, so that the corrected gamma reference voltage may be applied to each of the DACs 36. The method of applying the gamma reference voltages stored in the look-up table is not limited to the above description.

When the first driver IC IC1 and the second driver IC IC2 share the same look-up table, the first driver IC IC1 and the second driver IC IC2 generate gamma voltages on the basis of the same corrected gamma reference voltages. Accordingly, the grayscale variation between the first block B1 and the second block B2 that are controlled by the first driver IC IC1 and the second driver IC IC2, respectively, may be eliminated Consequently, the block dim effect may be prevented.

It will be understood by those skilled in the art that the present disclosure can be embodied in other specific forms without changing the technical idea or essential characteristics of the present disclosure. Therefore, it should be understood that the embodiments described above are illustrative in all aspects and not restrictive. The scope of the present disclosure is characterized by the appended claims rather than the detailed description described above, and it should be construed that all alterations or modifications derived from the meaning and scope of the appended claims and the equivalents thereof fall within the scope of the present disclosure.

What is claimed is:

1. A display device comprising:

a display panel on which multiple pixels are arranged;

a first driver integrated circuit (IC) controlling driving of first pixels from the multiple pixels arranged in a first area of the display panel, and including a first gamma generator that outputs multiple gamma voltages; and a second driver IC controlling driving of second pixels from the multiple pixels arranged in a second area of the display panel, and including a second gamma generator that outputs the multiple gamma voltages, wherein each of the first gamma generator and the second gamma generator generates the multiple gamma voltages by using multiple gamma reference voltages output from the first gamma generator, wherein each of the first gamma generator and the second gamma generator comprises:

a reference voltage generator generating a reference voltage from the driving voltage; and a gamma voltage generator generating the multiple gamma reference voltages using the reference voltage, wherein the gamma voltage generator comprises:

a first circuit part generating a first plurality of gamma reference voltages from the multiple gamma reference voltages using the reference voltage, the first circuit part including a first resistor string, a plurality of first buffers including a first buffer and a second buffer, an input of the first resistor string connected to an input of the first buffer and the reference voltage, and an output of the first resistor string connected to an input of the second buffer, wherein the first plurality of gamma reference voltages are output by the first buffer and the second buffer; and a second circuit part generating a second plurality of gamma reference voltages from the multiple gamma reference voltages using the first plurality of gamma reference voltages generated by the first circuit part, the second circuit part including a second resistor string and a plurality of second buffers connected to the second resistor string, wherein an input of the second resistor string is connected to an output of the first buffer of the first circuit part;

a decoder generating the gamma voltages using the multiple gamma reference voltages output from the first circuit part and the second circuit part, the decoder connected to outputs of the plurality of buffers of the second circuit part; and wherein the first gamma voltage generator outputs the generated multiple gamma reference voltages to the decoder of the second gamma voltage generator and the decoder of the second gamma voltage generator receives the multiple gamma reference voltages generated by the first circuit and generates multiple gamma voltages of the second circuit using the generated multiple gamma reference voltages received from the first circuit.

2. The display device of claim 1, wherein each of the first driver IC and the second driver IC comprises a first power supply and a second power supply that generate a driving voltage.

3. The display device of claim 2, the gamma voltage generator of the first circuit generates the first plurality of gamma reference voltages by dividing the reference voltage using the first resistor string and generates the second plurality of gamma reference voltages by dividing the first plurality of gamma reference voltages using the second resistor string, and generates the multiple gamma voltages that correspond to multiple grayscales, respectively, by dividing the first plurality of gamma reference voltages and the second plurality of gamma reference voltages using the decoder.

4. The display device of claim 1, wherein an input terminal of the decoder of the second gamma generator is connected to an output terminal of the second circuit part of the first gamma generator.

5. The display device of claim 4, wherein the plurality of first buffers and the plurality of second buffers of the second gamma generator are controlled to be in an off state.

6. A display device comprising:

a display panel on which multiple pixels are arranged;

a first driver integrated circuit (IC) controlling driving of first pixels from the multiple pixels arranged in a first area of the display panel, and including a first gamma generator that outputs multiple gamma voltages;

a second driver IC controlling driving of second pixels from the multiple pixels arranged in a second area of the display panel, and including a second gamma generator that outputs the multiple gamma voltages; and a first memory storing a look-up table that includes gamma reference voltages;

wherein each of the first gamma generator and the second gamma generator generates the multiple gamma voltages by using the multiple gamma reference voltages output from the first gamma generator, wherein each of the first gamma generator and the second gamma generator comprises:

a control interface communicating with an external host;

a second memory storing initially set gamma reference voltages;

at least one register loading the initially set gamma reference voltages from the second memory, comparing the initially set gamma reference voltages from the second memory with the gamma reference voltages included in the look-up table of the first memory, correcting the initially set gamma reference voltages from the second memory based on the comparison, and outputting the corrected gamma reference voltages to multiple nodes, respectively;

multiple digital-to-analog converters converting multiple corrected gamma reference voltages input from the at least one register into the multiple gamma voltages and outputting the multiple gamma voltages; and multiple buffers stabilizing and outputting the multiple gamma voltages output from the multiple digital-to-analog converters, and wherein the gamma reference voltages stored in the look-up table corresponds to the multiple nodes of the register, respectively.

7. The display device of claim 6, wherein the second memory is provided in each of the first driver IC and the second driver IC.

8. The display device of claim 2, wherein each of the first driver IC and the second driver IC further comprises:

a timing controller outputting image data and control signals based on an image signal applied from outside; and a data driver generating data signals on the basis of the image data, the control signals, and the gamma voltages, and applying the data signals to the pixels.

9. The display device of claim 8, wherein each of the first driver IC and the second driver IC further comprises a synchronizer synchronizing operation timing by exchanging synchronization signals with each other.

10. A display device comprising:

a first gamma voltage generator generating multiple first gamma reference voltages from first driving power, and generating multiple first gamma voltages that correspond to multiple grayscales, respectively, by dividing the multiple first gamma reference voltages; and a second gamma voltage generator generating multiple second gamma voltages by using the multiple first gamma reference voltages generated from the first gamma voltage generator, wherein each of the first gamma voltage generator and the second gamma voltage generator comprises:

a first circuit part generating a first plurality of gamma reference voltages from the multiple first gamma reference voltages by dividing a reference voltage, the first circuit part including a first resistor string, a plurality of first buffers including a first buffer and a second buffer, an input of the first resistor string connected to an input of the first buffer and the reference voltage, and an output of the first resistor string connected to an input of the second buffer, wherein the first plurality of gamma reference voltages are output by the first buffer and the second buffer;

a second circuit part generating a second plurality of gamma reference voltages from the multiple first gamma reference voltages using the first plurality of gamma reference voltages generated by the first circuit part, the second circuit part including a second resistor string and a plurality of second buffers connected to the second resistor string, wherein an input of the second resistor string is connected to an output of the first buffer of the first circuit part; and a decoder generating the gamma voltages by dividing the first plurality of gamma reference voltages and the second plurality of gamma reference voltages respectively output from the first circuit part and the second circuit part; and wherein the first gamma voltage generator outputs the generated multiple gamma reference voltages to the decoder of the second gamma voltage generator.

11. The display device of claim 10, wherein the second gamma voltage generator generates multiple second gamma reference voltages from second driving power that is different from the first driving power.

12. The display device of claim 10, wherein an input terminal of the decoder of the second gamma voltage generator is connected to an output terminal of the second circuit part of the first gamma voltage generator.

* * * * *